US010851648B2

(12) United States Patent
Siefert

(10) Patent No.: US 10,851,648 B2
(45) Date of Patent: Dec. 1, 2020

(54) SUSPENDED FLUID SAMPLING AND MONITORING

(71) Applicant: GAS SENSING TECHNOLOGY CORP., Laramie, WY (US)

(72) Inventor: Michael Siefert, Narangba (AU)

(73) Assignee: GAS SENSING TECHNOLOGY CORP., Laramie, WY (US)

( * ) Notice: Subject to any disclaimer, the term of this patent is extended or adjusted under 35 U.S.C. 154(b) by 347 days.

(21) Appl. No.: 15/578,616

(22) PCT Filed: May 31, 2016

(86) PCT No.: PCT/US2016/034951
§ 371 (c)(1),
(2) Date: Nov. 30, 2017

(87) PCT Pub. No.: WO2016/196425
PCT Pub. Date: Dec. 8, 2016

(65) Prior Publication Data

US 2018/0163536 A1 Jun. 14, 2018

Related U.S. Application Data

(60) Provisional application No. 62/168,981, filed on Jun. 1, 2015.

(51) Int. Cl.
*E21B 49/08* (2006.01)
*E21B 47/06* (2012.01)
(Continued)

(52) U.S. Cl.
CPC ..... *E21B 49/082* (2013.01); *E21B 33/068* (2013.01); *E21B 47/06* (2013.01);
(Continued)

(58) Field of Classification Search
CPC ..... E21B 49/084; E21B 47/06; E21B 19/22
See application file for complete search history.

(56) References Cited

U.S. PATENT DOCUMENTS 3,127,933 A 4/1964 Graham et al.
5,176,207 A * 1/1993 Keller ..... E21B 19/22 166/250.01

(Continued)

FOREIGN PATENT DOCUMENTS

CA 2704476 A1 5/2009
CA 2900968 A1 8/2014

OTHER PUBLICATIONS

International Search Report and Written Opinion issued in PCT/US16/34951, dated Oct. 14, 2016, 17 pages.

*Primary Examiner* — Shane Bomar
(74) *Attorney, Agent, or Firm* — Adolph Locklar

(57) ABSTRACT

A suspended fluid sampling and monitoring system includes a BOP, the BOP attached to a wellhead. The BOP is positioned above a wellbore. The suspended fluid sampling and monitoring system further includes a TEC, the TEC connected to a sensor package. The TEC and sensor package extend through the BOP into the wellbore. The suspended fluid sampling and monitoring system also includes a fluid sample line, the fluid sample line extending through the BOP into the wellbore. The suspended fluid sampling and monitoring system also includes a fluid sample intake and filtration device, the fluid sample intake and filtration device mechanically coupled to the fluid sample line within the wellbore.

19 Claims, 16 Drawing Sheets

(51) Int. Cl.

| | |
|---|---|
| ***E21B 33/068*** | (2006.01) |
| ***E21B 47/07*** | (2012.01) |
| *E21B 33/06* | (2006.01) |
| *E21B 34/02* | (2006.01) |
| *E21B 47/12* | (2012.01) |

(52) U.S. Cl.

CPC ..... *E21B 47/07* (2020.05); *E21B 49/081* (2013.01); *E21B 49/084* (2013.01); *E21B 33/06* (2013.01); *E21B 34/02* (2013.01); *E21B 47/12* (2013.01); *E21B 49/0875* (2020.05)

(56) References Cited

U.S. PATENT DOCUMENTS

| | | | | |
|---|---|---|---|---|
| 5,206,505 | A | 4/1993 | Sprunt | |
| 5,503,014 | A | 4/1996 | Griffith | |
| 5,598,866 | A * | 2/1997 | Nelson | B65H 75/425 137/355.12 |
| 6,662,644 | B1 | 12/2003 | Grotendorst et al. | |
| 7,748,466 | B2 * | 7/2010 | Aivalis | E21B 4/02 166/383 |
| 7,784,537 | B2 * | 8/2010 | Baxter | B21D 43/28 166/241.5 |
| 8,286,703 | B2 * | 10/2012 | Clapp | E21B 33/1246 166/250.17 |
| 2002/0012837 | A1 | 1/2002 | Hensley et al. | |
| 2002/0070030 | A1 * | 6/2002 | Smith | E21B 33/0407 166/379 |
| 2006/0155472 | A1 | 7/2006 | Venkataramanan et al. | |
| 2013/0272898 | A1 | 10/2013 | Toh et al. | |
| 2014/0305628 | A1 | 10/2014 | Freifeld | |
| 2015/0068738 | A1 * | 3/2015 | Wayne | E21B 47/06 166/250.11 |
| 2017/0167255 | A1 * | 6/2017 | Zhang | G01N 1/16 |
| 2018/0363460 | A1 * | 12/2018 | Fitzel | E21B 49/081 |

* cited by examiner

SUSPENDED FLUID SAMPLING AND MONITORING

CROSS-REFERENCE TO RELATED APPLICATIONS

This application is a National Stage Entry of PCT/US16/34951, filed May 31, 2016; which itself claims priority from U.S. provisional application No. 62/168,981, filed Jun. 1, 2015. The entireties of both PCT/US16/34951 and U.S. 62/168,981 are incorporated herein by reference.

FIELD OF THE DISCLOSURE

The disclosure relates to an apparatus, system and method for suspending and retrieving sensors in a borehole as well as to extract fluid samples from the borehole.

BACKGROUND

Reference to background art herein is not to be construed as an admission that such art constitutes common general knowledge.

Monitoring of aquifers positioned above, between, below or in close proximity to conventional reservoir formations containing hydrocarbons, such as sandstones and carbonates and unconventional reservoir formations, such as coal seams and shales, is often conducted in accordance with the policies of the operating energy companies, or under state or federal legislation. For instance, in Queensland, Australia, the Petroleum and Gas (Production and Safety) Act 2004 and Petroleum Act 1923 authorizes petroleum tenure holders to undertake activities related to the exploration for, and production of, petroleum and gas. This authorization also includes the right to take or interfere with groundwater. However, in Australia, the Water Act 2000 establishes responsibilities for petroleum tenure holders to monitor and manage the impacts caused by the exercise of these groundwater rights, including a responsibility to remedy any impairment of private bore water supplies.

Traditionally, when water is extracted from a gas well, groundwater levels decline in the area surrounding the well. If multiple gas fields are adjacent to each other, the impact of water extraction on groundwater levels from each well may overlap. In these situations, a cumulative approach may be necessary for the assessment and management of groundwater level impacts.

Conventional coal seam gas production involves pumping large quantities of groundwater from coal formations to reduce the water pressure in the coal seams, releasing the gas that is attached to the coal. For instance, coal seam gas is produced from the Walloon Coal Measures of the Surat Basin and the Bandanna Formation of the Bowen Basin. These coal-bearing formations consist of many thin coal seams separated by low permeability rock. The coal seams collectively comprise a small proportion of the total thickness of the coal bearing formations. The Walloon Coal Measures are a geologic layer of the Great Artesian Basin, which comprises layers of lower permeability rocks alternating with aquifers of high economic importance. The Great Artesian Basin also feeds springs of high ecological and cultural importance.

When water is extracted from coal formations, the water from surrounding aquifers may flow into the coal formations. The degree of interconnection among coal bearing formations and surrounding aquifers in part determines the extent to which water extraction from the coal seams affects water levels in bores in surrounding aquifers. When the water pressure in a coal formation is reduced, such as by removal of water from the coal formation, the coal formation is not dewatered, but remains saturated due to flow from the interconnected aquifer.

A reduction in water pressure in a confined aquifer will manifest as a decline in the water level in a bore that taps the aquifer. Water in the aquifers may be contaminated by ingress of water to the aquifer from coal formations.

Traditionally, the capital expenditure for tubing-deployed aquifer water level monitoring systems may be significant relative to the value of the aquifer and/or the coal formation. In certain traditional embodiments, a workover rig is required to install and retrieve a tubing-deployed aquifer level monitoring system, adding significant operational expenditure.

Conventional fluid sampling may be conducted by first bailing or swabbing out the contents of the monitoring boreholes using a wireline unit or swabbing unit respectively. Water from the surrounding the aquifer enters the bailed or swabbed out borehole. A water sampler on wireline is then lowered into the monitoring borehole to capture a sample of fluid. In an alternative conventional fluid sample technique, low-flow-rate bladder pumping systems are lowered and installed in the monitoring boreholes to extract fluid from the aquifers. Operation of low-flow-rate bladder pumps is traditionally limited to depths above 1000 ft. While submersible rotary or reciprocating pumps can be used in place of low-flow-rate bladder pumps for use at greater depths, submersible rotary or reciprocating pumps may be prohibitively expensive. In addition, all pumps are prone to periodic failure, necessitating retrieval and replacement, for instance, by using workover rigs.

SUMMARY

The present disclosure is directed to a suspended fluid sampling and monitoring system. The suspended fluid sampling and monitoring system includes a BOP, the BOP attached to a wellhead. The BOP is positioned above a wellbore. The suspended fluid sampling and monitoring system further includes a TEC, the TEC connected to a sensor package. The TEC and sensor package extend through the BOP into the wellbore. The suspended fluid sampling and monitoring system also includes a fluid sample line, the fluid sample line extending through the BOP into the wellbore. The suspended fluid sampling and monitoring system also includes a fluid sample intake and filtration device, the fluid sample intake and filtration device mechanically coupled to the fluid sample line within the wellbore.

Another embodiment of the present disclosure is directed to a suspended fluid sampling and monitoring system. The suspended fluid monitoring and sampling system includes a BOP, where the BOP is attached to a wellhead, and the BOP is positioned above a wellbore. The suspended fluid sampling and monitoring system also includes a TEC, the TEC connected to a sensor package. The TEC extends through the BOP into the wellbore. The TEC has a free end located outside the wellbore. The suspended fluid sampling and monitoring system further includes a fluid sample line, the fluid sample line extending through the BOP into the wellbore. The fluid sample line has a free end located outside the wellbore. The fluid sample line terminates in a fluid sample intake and filtration device. The suspended fluid sampling and monitoring system includes an HWO, the HWO mechanically connected to the fluid sample line, and a EWO, the EWO mechanically connecting the TEC to a surface electrical cable.

Yet another embodiment of the present disclosure is directed to a method. The method includes providing a fluid sample line, the fluid sample line passing through a first port in a wellbore adapter spool and into a wellbore. The wellbore contains fluid. The wellbore adapter spool is in fluid communication with the wellbore. The method also includes providing a TEC, where the TEC passes through a second port in the wellbore adapter spool and into the wellbore. In addition, the method includes providing a BCM, where the BCM is connected to a blowdown port in the wellbore adapter spool. The method also includes providing a BOM, where the BOM is connected to a bleedoff port in the wellhead adapter spool. The method includes calibrating by blowing down the fluid from an initial fluid height to a fluid height after calibration and allowing the fluid to return to an initial fluid height. The method also includes initially blowing down the fluid from the initial fluid height after the calibration step to a second fluid height after purge using a first gas cap pressure. The method includes allowing fluid to enter the wellbore from an aquifer to reach the initial fluid height and blowing down the fluid from the initial fluid height to a fluid height after recovery using a second gas cap pressure.

BRIEF DESCRIPTION OF THE DRAWINGS

The present disclosure may be understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIGS. 7B1-7B3 depict ram components consistent with at least one embodiment of the present disclosure.

DETAILED DESCRIPTION OF THE DISCLOSURE

A detailed description will now be provided. The following disclosure includes specific embodiments, versions and examples, but the disclosure is not limited to these embodiments, versions or examples, which are included to enable a person having ordinary skill in the art to make and use the disclosure when the information in this application is combined with available information and technology.

Various terms as used herein are shown below. To the extent a term used in a claim is not defined below, it should be given the broadest definition persons in the pertinent art have given that term as reflected in printed publications and issued patents. Further, unless otherwise specified, all compounds described herein may be substituted or unsubstituted and the listing of compounds includes derivatives thereof.

Further, various ranges and/or numerical limitations may be expressly stated below. It should be recognized that unless stated otherwise, it is intended that endpoints are to be interchangeable. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.).

Figure 1:
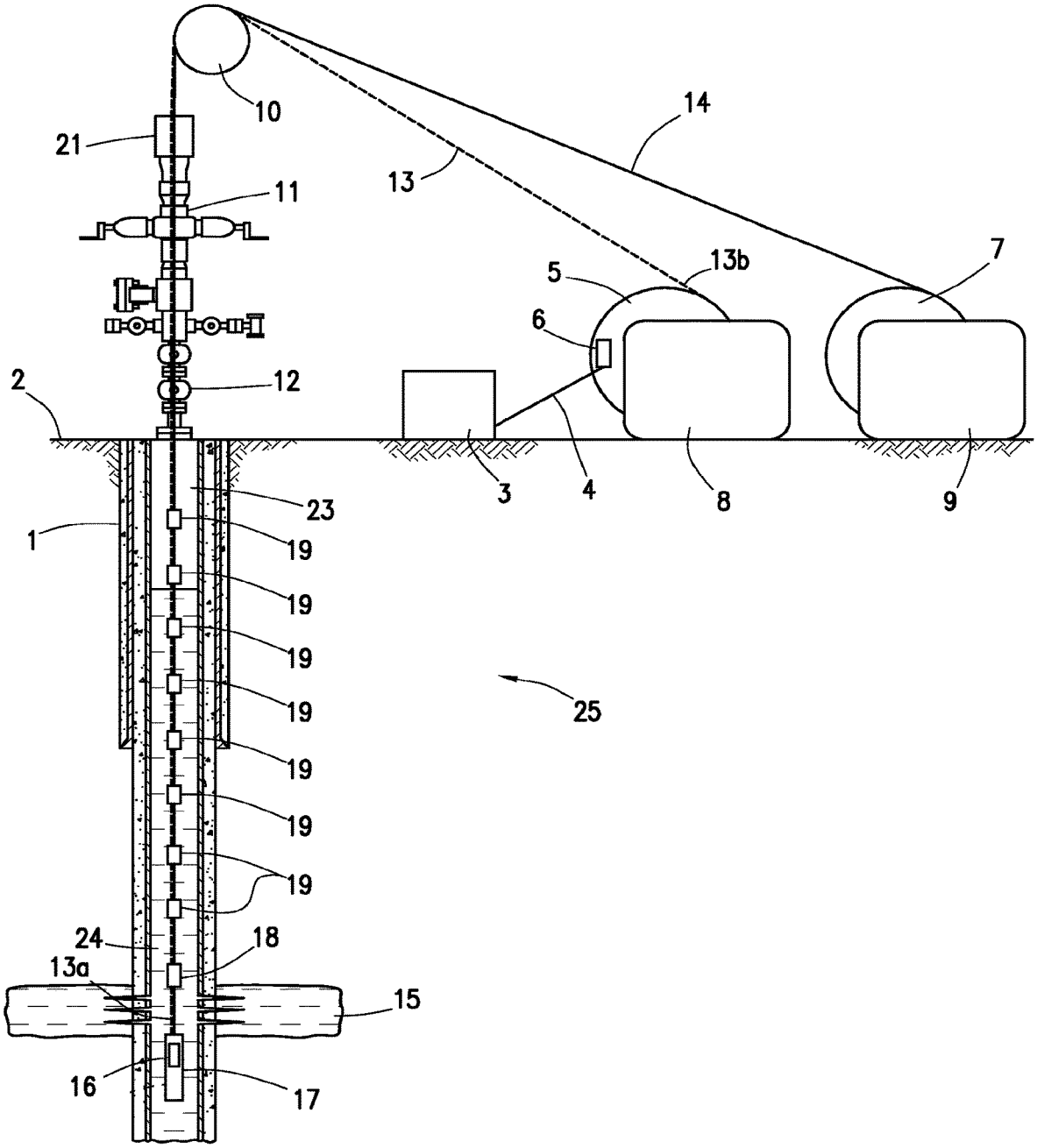
FIG. 1 depicts a suspended fluid sampling and monitoring system consistent with at least one embodiment of the present disclosure.

Certain embodiments of the present disclosure are directed to a suspended fluid sampling and monitoring system. FIG. 1 depicts an embodiment of suspended fluid sampling and monitoring system 25. Some embodiments of suspended fluid sampling and monitoring system 25 are single-zone suspended fluid sampling and monitoring systems. In some embodiments, suspended fluid sampling and monitoring system 25 may be deployed and retrieved without a drilling or workover rig. The downhole portion of suspended fluid sampling and monitoring system 25 is positioned in borehole 1. In certain embodiments, wellhead 12 and blow out preventer (BOP) 11 may be used for equipment suspension and well control within borehole 1. BOP 11 may be attached to wellhead 12; BOP 11 may be positioned above borehole 1. In certain embodiments, borehole 1 may include fluid 24 within borehole 1 and head space 23 above fluid 24. Fluid 24 may include water.

In the embodiment depicted in FIG. 1, bottom end 13*a* of tubing encapsulated cable (TEC) 13 is connected to sensor package 16 mounted in bottom hole assembly (BHA) toolstring 17. Sensor package 16 may measure conditions within borehole 1, including, but not limited to, pressure and temperature. In certain embodiments, temperature measurements made by sensor package 16 may be used to compensate pressure measurements. In some embodiments, sensor package 16 may measure, in addition to temperature and pressure, for instance, fluid conductivity and pH. TEC 13 and sensor package 16 may extend through BOP 11 and into wellbore 1.

Electrical power may be transmitted to sensor package 16 by a surface telemetry unit 3 via a surface electrical cable 4 and TEC 13. Surface electrical cable 4 may be electrically coupled to surface end 13*b* of TEC 13. As shown in FIG. 1, surface end 13*b* of TEC 13 may be spooled on TEC reel 5 into junction box 6. FIG. 1 depicts TEC reel 5 mechanically attached to TEC spooling unit 8. TEC spooling unit 8 may be used to deploy BHA toolstring 17. After BHA toolstring 17 has reached a predetermined depth, TEC reel 5 may be detached from TEC spooling unit 8, allowing TEC spooling unit 8 to be removed. Surface telemetry unit 3 may process, store and/or transmit data measurements via shared or dedicated telecommunications equipment (not shown) to receiving telecommunications equipment. Receiving telecommunications equipment may be located at wellsite or away from the wellsite.

With further attention to FIG. 1, fluid sample line 14 may extend from hydraulic tube reel 7. Hydraulic tube reel 7 may be positioned within tube spooling unit 9. Fluid sample line 14 is adapted to transport fluid samples from fluid 24 within borehole 1 to surface 2. In certain embodiments, fluid sample line 14 may extend through BOP 11 and into wellbore 1. Fluid sample line 14 may terminate within borehole 1 at and be mechanically connected to fluid sample intake and filtration device 18 within wellbore 1. Fluid sample intake and filtration device 18 is adapted to retrieve fluid samples from fluid 24 within borehole 1. In some embodiments, fluid sample volumes may be between 1 and 10 L, between 2 and 7 L, or around 5 L. In certain embodiments, fluid intake and filtration device 18 may be positioned within close proximity to perforations extending into geological formation 15, such as an aquifer, situated below surface 2. In certain embodiments, fluid intake and filtration device 18 may be at depths less than 1000 m within borehole 1. The fluid samples may be transported to surface 2 through fluid sample line 14. In certain embodiments, fluid sample line 14 may be deployed within borehole 1 alongside TEC 13. In certain embodiments, TEC 13 and fluid sample line 14 may be suspended by sheave 10 located between hydraulic tube reel 7 and TEC reel 5 and BOP clamp housing 21.

In the embodiment depicted in FIG. 1, fluid sample line 14 is terminated within fluid sample intake and filtration device 18 positioned above BHA toolstring 17. Fluid sample intake and filtration device 18 may include a separate passageway for TEC 13. Fluid sample line 14 may be clamped to TEC 13 at intervals with multi-line clamps 19. The weight of the negatively buoyant BHA toolstring 17, TEC 13 and fluid sampling line 14 within borehole 1 may be fully supported by BOP clamp housing 21, as described hereinbelow.

In certain embodiments, TEC 13, fluid sample line 14, and sensor package 16 may be suspended from BOP 11. In other embodiments, fluid sample line 14 is suspended from BOP 11. In yet other embodiments, such as where BOP 11 is omitted, none of TEC 13, fluid sample line 14 or sensor package 16 are suspended from BOP 11. In embodiments where TEC 13 is not used, fluid sample line 14 may be attached to BHA toolstring 17 as described with respect to TEC 13, with fluid 24 entering fluid sample line 14 via fluid entry ports 107 (shown in FIG. 9) in BHA toolstring 17.

Figure 2:
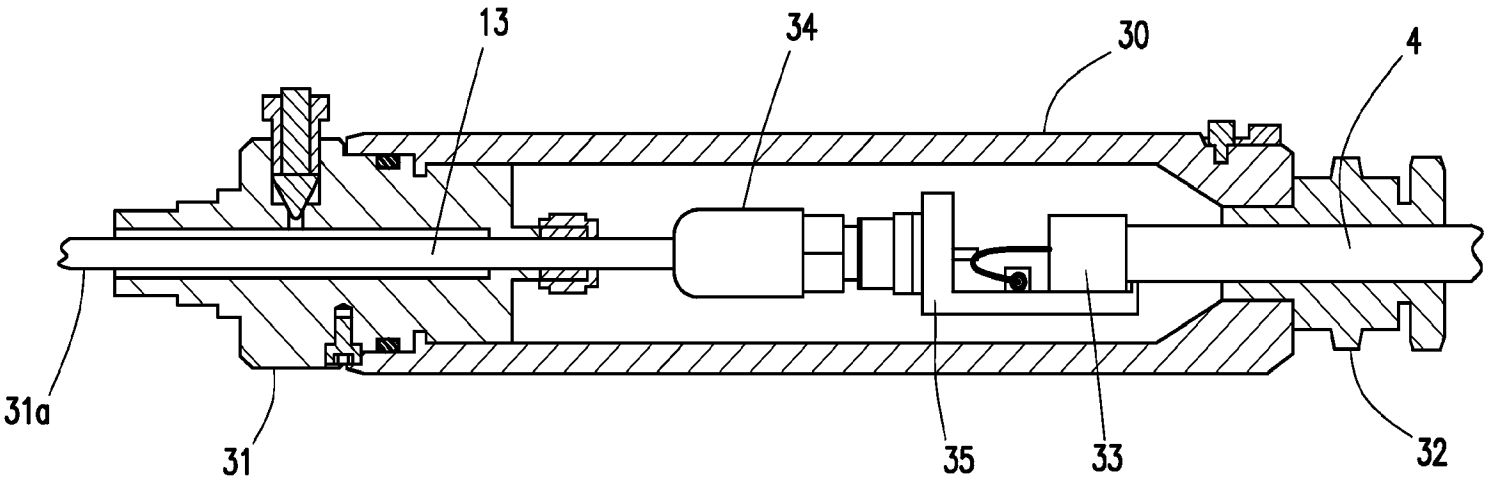
FIG. 2 depicts a cross-section of an electrical wellhead outlet consistent with at least one embodiment of the present disclosure.
Figure 3B:
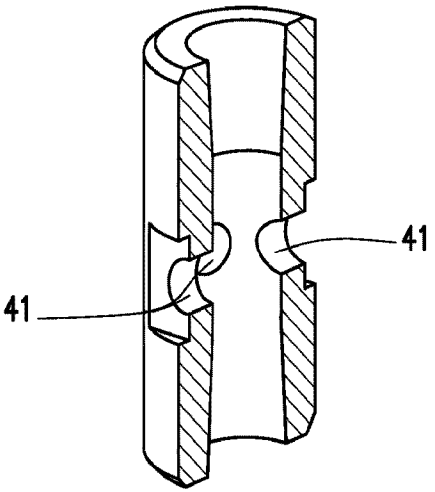
FIG. 3B depicts a cross-section of the wellhead adapter spool of FIG. 3A.
Figure 3A:
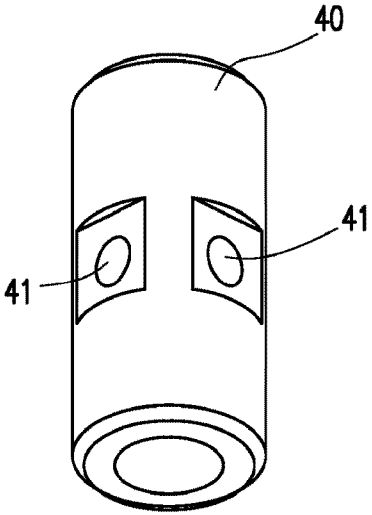
FIG. 3A depicts a wellhead adapter spool consistent with at least one embodiment of the present disclosure.

Surface electrical cable 4 may be mechanically and electrically connected to TEC 13 through electrical wellhead outlet (EWO) 30, as shown in FIG. 2. EWO 30 may be mounted on wellhead adapter spool 40 (shown in FIGS. 3A, 3B) or on a frame clamped to BOP 11. In some embodiments, TEC 13 extends up borehole 1 from BHA 17, exiting BOP clamp housing 21. TEC 13 may be cut at TEC reel 5. Free end 31*a* of TEC 13 may be connected through one of four ports 41 (for instance, a first port) in wellhead adapter spool 40, as shown in FIGS. 3A, 3B, and, as shown in FIG. 2, passed through feedthrough assembly 31 in EWO 30. Free end 31*a* of TEC 13 may be crimped onto TEC electrical connector 34 within EWO 30. Surface electrical cable 4 may be routed through packing gland 32, with the wires of surface electrical cable 4 terminated in terminal block 33 mounted on rail 35 attached to TEC electrical connector 34.

FIG. 3A depicts wellhead adapter spool 40. Wellhead adapter spool 40 may be mechanically coupled to BOP clamp housing 21 or between BOP 11 and wellhead 12. Wellhead adapter spool 40 may be used in certain embodiments to attach EWO 30, hydraulic wellhead outlet (HWO) 50 (depicted in FIG. 4), blowdown control manifold (BCM) 120 (depicted in FIG. 11) and bleed off manifold (BOM) 130 (depicted in FIG. 12) to BOP 11. FIG. 3B depicts the cross-section of wellhead adapter spool 40.

Figure 4:
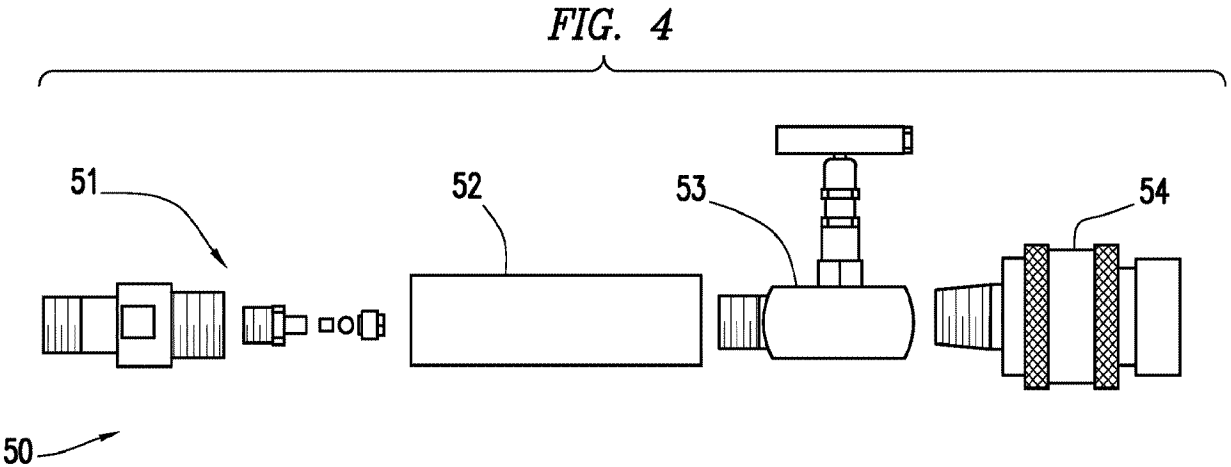
FIG. 4 depicts a hydraulic wellhead outlet consistent with at least one embodiment of the present disclosure.

FIG. 4 depicts HWO 50. HWO 50 may be mounted on wellhead adapter spool 40 or on a frame clamped to BOP 11. Fluid sample line 14 may be terminated at surface 2 through HWO 50. Fluid sample line 14 may be mechanically connected to HWO 50. Fluid sample line 14 may extend up borehole 1 from sample intake and filtration device 18 and exit BOP clamp housing 21. Fluid sample line 14 may be cut at hydraulic tube reel 7, with the free end of fluid sample line 14 routed through one of four ports 41 (for instance, a second port) in wellhead adapter spool 40 and terminated through the pressure blocked feedthrough assembly 51 in HWO 50. HWO 50 may also include feedthrough connector 52. Feedthrough connector 52 mechanically couples pressure blocked feedthrough assembly 51 to pressure and sample release valve 53. In the embodiment shown in FIG. 4, pressure and sample release valve 53 is mechanically coupled to quick connect fitting 54. Quick connect fitting 54 may be used to couple to, for instance, a hose.

Figure 13:
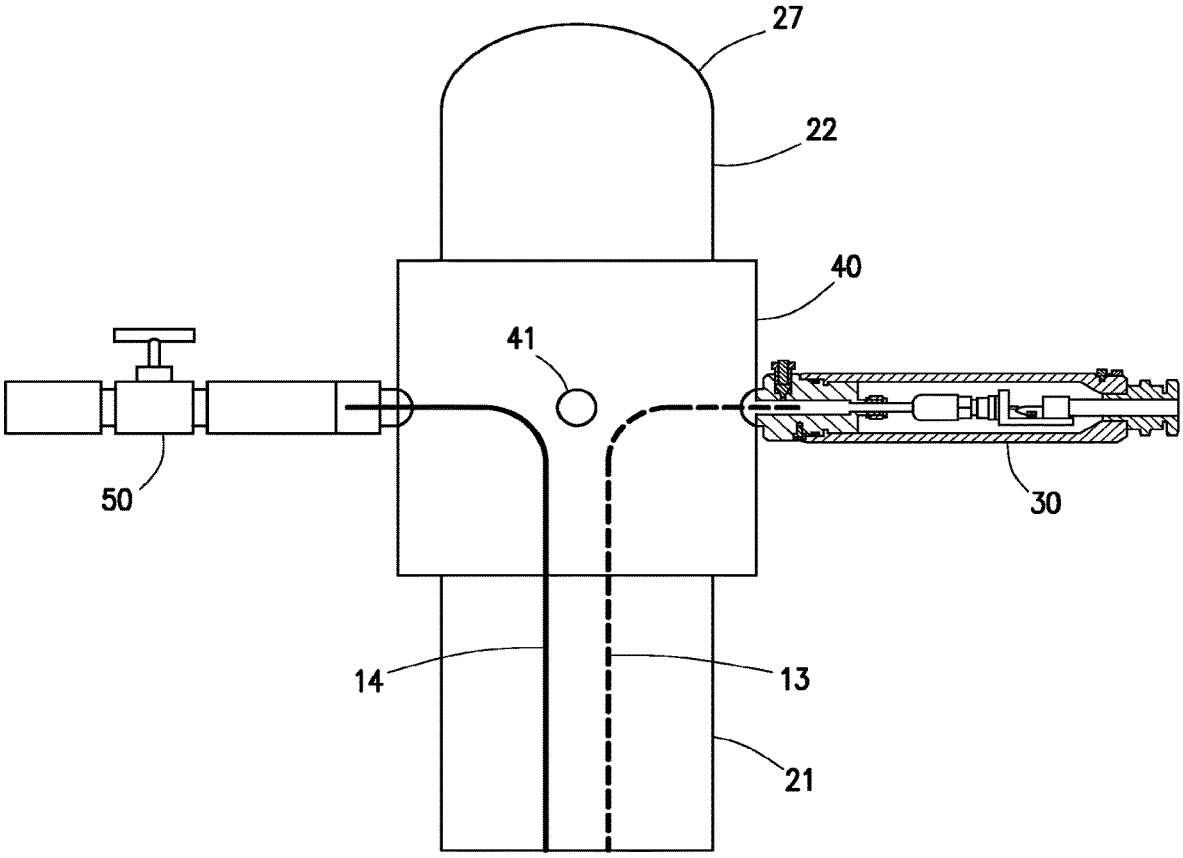
FIG. 13 depicts a top portion of suspended fluid sampling and monitoring system consistent with at least one embodiment of the present disclosure.

FIG. 13 depicts upper section 27 of suspended fluid sampling and monitoring system 25. As shown in FIG. 13, bullplug 22 is mounted on top of wellhead adapter spool 40. HWO 50 and EWO 30 are coupled to ports 41 of wellhead adapter spool 40. Wellhead adapter spool 40 is mechanically coupled to BOP clamp housing 21. Fluid sample line 14 and TEC 13 extend longitudinally along the interior of BOP clamp housing 21.

Figure 14:
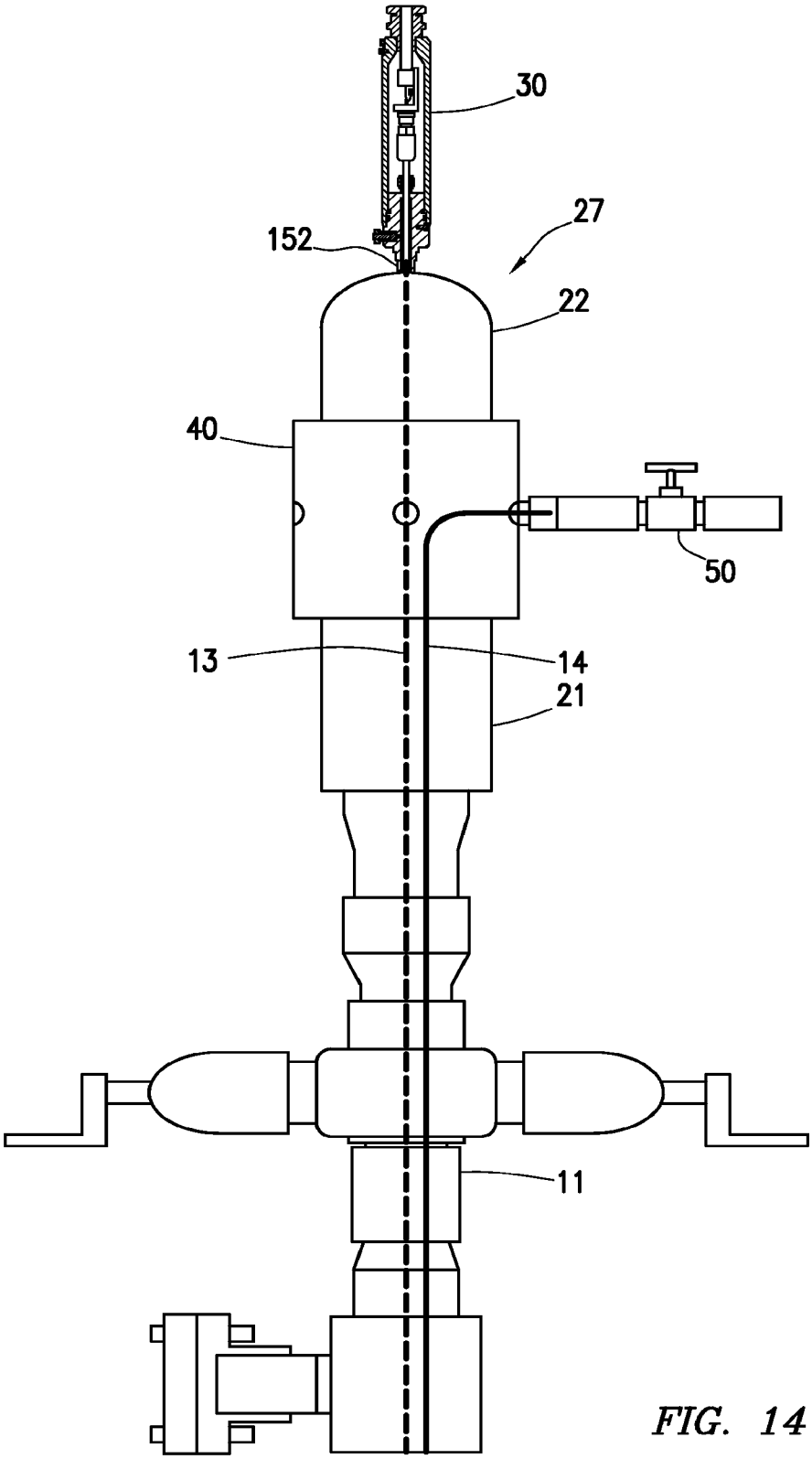
FIG. 14 depicts a top portion of suspended fluid sampling and monitoring system consistent with at least one embodiment of the present disclosure.

In yet another embodiment, shown in FIG. 14, EWO 30 is mounted in bullplug port 152 incorporated in bullplug 22 mounted on BOP clamp housing 21. In the embodiment depicted in FIG. 14, HWO 50 terminates in wellhead adapter spool 40 positioned between BOP clamp housing 21 and bullplug 22. In yet another embodiment (not shown), the positions of EWO 30 and HWO 50 may be reversed, with EWO 30 terminated in wellhead adapter spool 40 and HWO 50 mounted in bullplug port 152.

Figure 15:
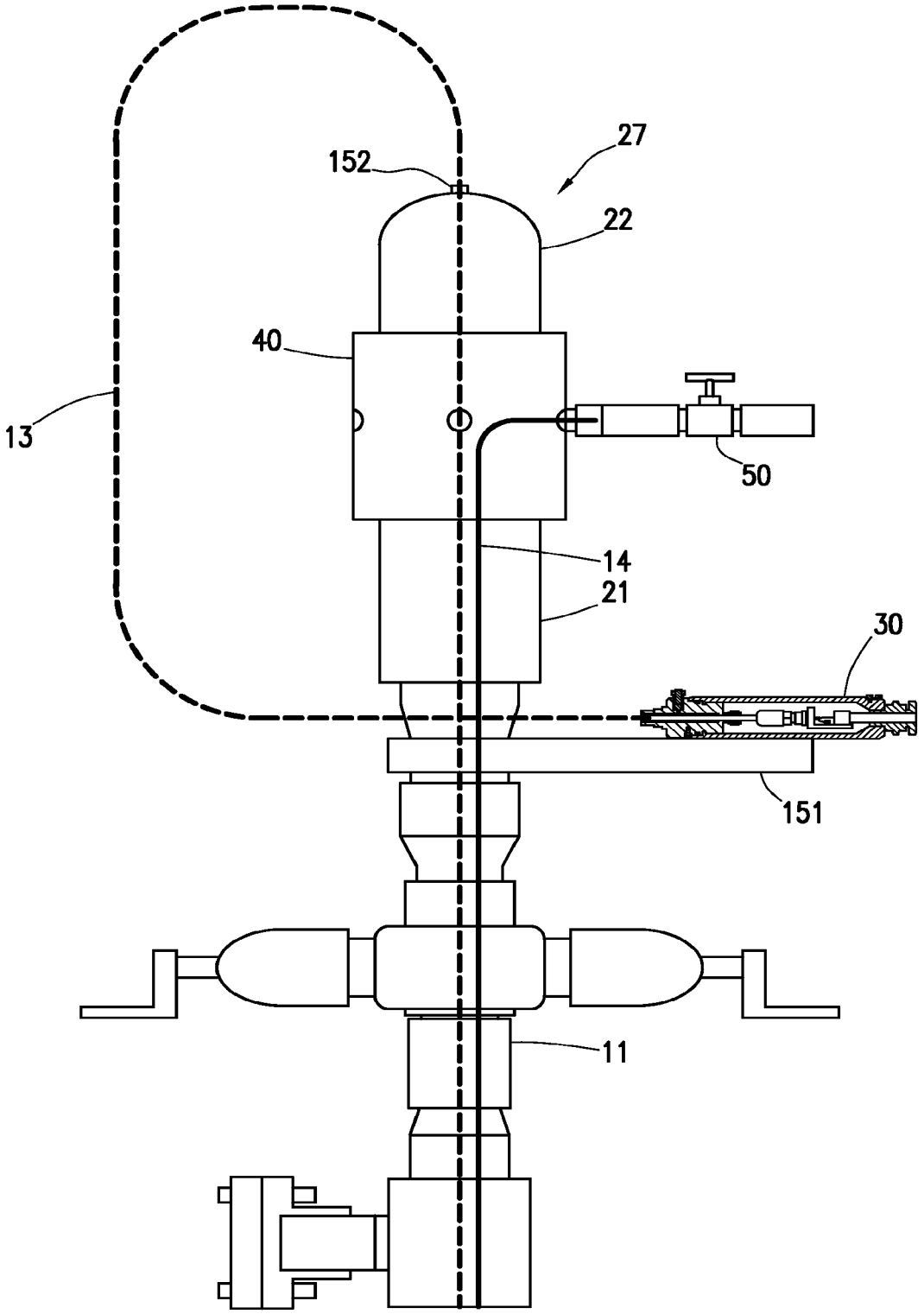
FIG. 15 depicts a top portion of suspended fluid sampling and monitoring system consistent with at least one embodiment of the present disclosure.

In yet another embodiment, as shown in FIG. 15, EWO 30 is mounted on bracket 151. Bracket 151 may be affixed to BOP 11, including for instance, by welding, clamping, braizing, or otherwise attaching. TEC 13 may exit EWO 30 and may sealedly enter bullplug port 152, such as through a compression fitting. HWO 50 may be terminated into wellhead adapter spool 40 positioned between BOP clamp housing 21 and bullplug 22. In yet another embodiment (not shown) the position of EWO 30 and HWO 50 are reversed, with HWO 50 mounted on bracket 151 and EWO 30 terminated into wellhead adapter spool 40. In yet other embodiments, bracket 151 can be affixed to BOP clamp housing 21, wellhead adaptor spool 40, or bullplug 22. In yet another embodiment, both EWO 30 and HWO 50 are mounted on single bracket 151 or individual brackets 151 that are affixed to BOP 11, BOP clamp housing 21, wellhead adaptor spool 40, bullplug 22 or any combination thereof.

Figure 16:
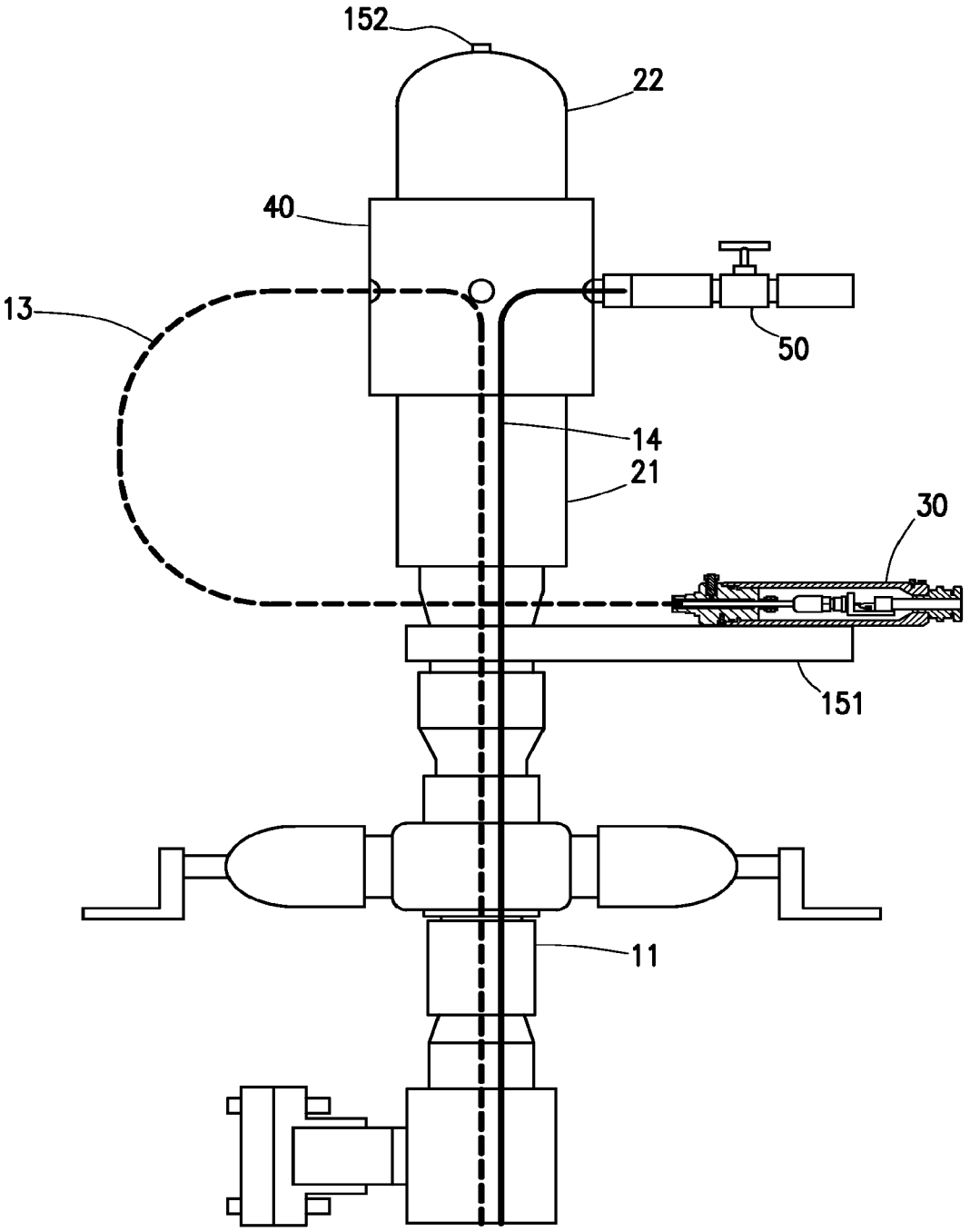
FIG. 16 depicts a top portion of suspended fluid sampling and monitoring system consistent with at least one embodiment of the present disclosure.

In yet another embodiment, shown in FIG. 16, EWO 30 is mounted on bracket 151 that is affixed to BOP 11, with TEC 13 sealed in one of ports 41 of wellhead adapter spool 40 using a fitting, such as a compression fitting. TEC 13 may be terminated into EWO 30, with HWO 50 terminated into wellhead adapter spool 40 positioned between BOP clamp housing 21 and bullplug 22. In yet another embodiment the position of the EWO 30 and HWO 50 in FIG. 16 are reversed, with HWO 50 mounted on bracket 151 and EWO 30 terminated into wellhead adapter spool 40.

EWO 30 and HWO 50 may be designed to provide well pressure control after BHA toolstring 17 has been deployed on TEC 13 in borehole 1.

In certain embodiments of the present disclosure, suspended fluid sampling and monitoring system 25 may omit one or more of sensor package 16, TEC 13, multi-line clamps 19, TEC reel 5, TEC spooling unit 8, EWO 30 (for example, in embodiments where TEC reel 5 is removed), surface electrical cable 4, and surface telemetry unit 3.

Figure 18:
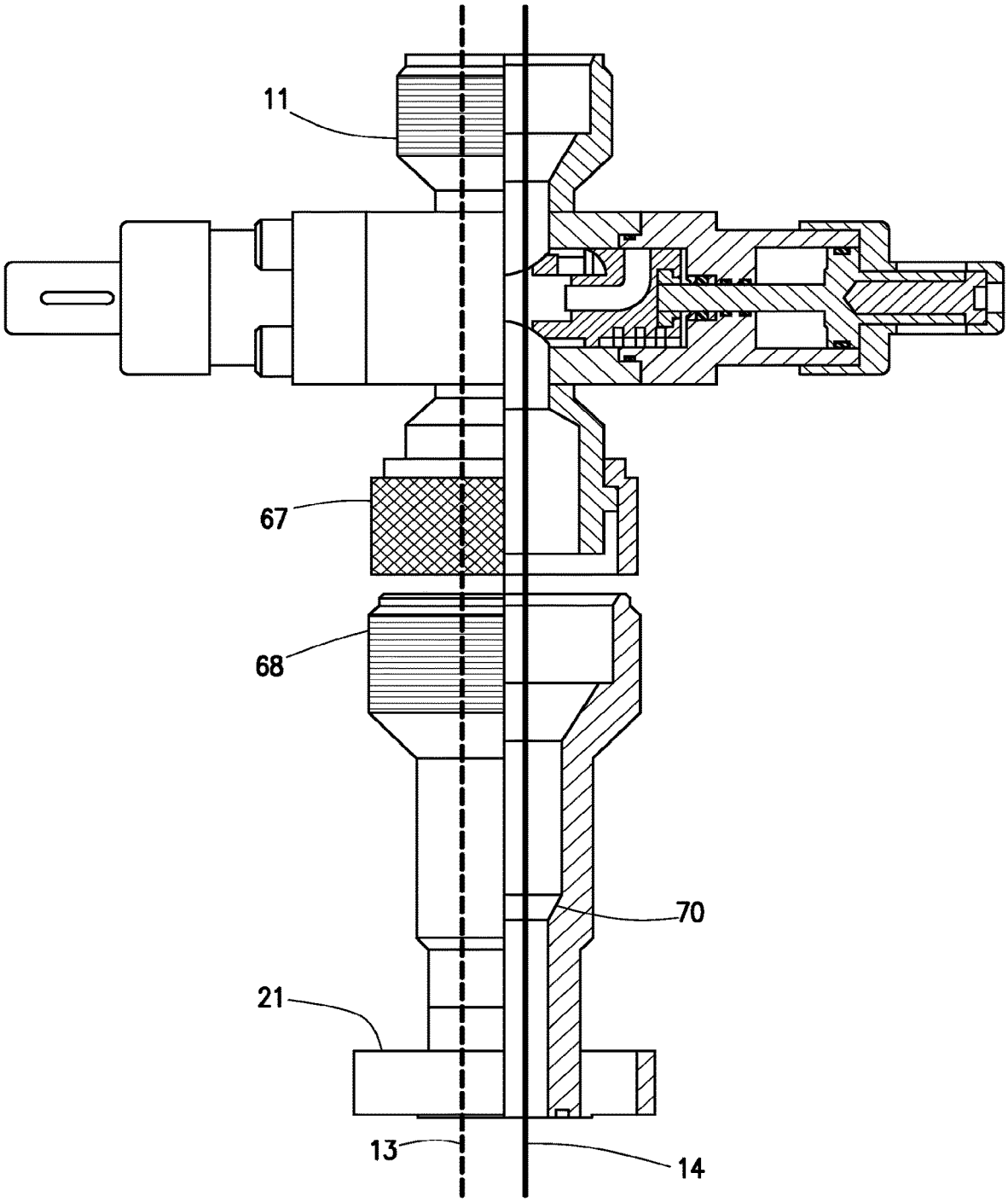
FIG. 18 depicts a top portion of suspended fluid sampling and monitoring system consistent with at least one embodiment of the present disclosure.
Figure 20:
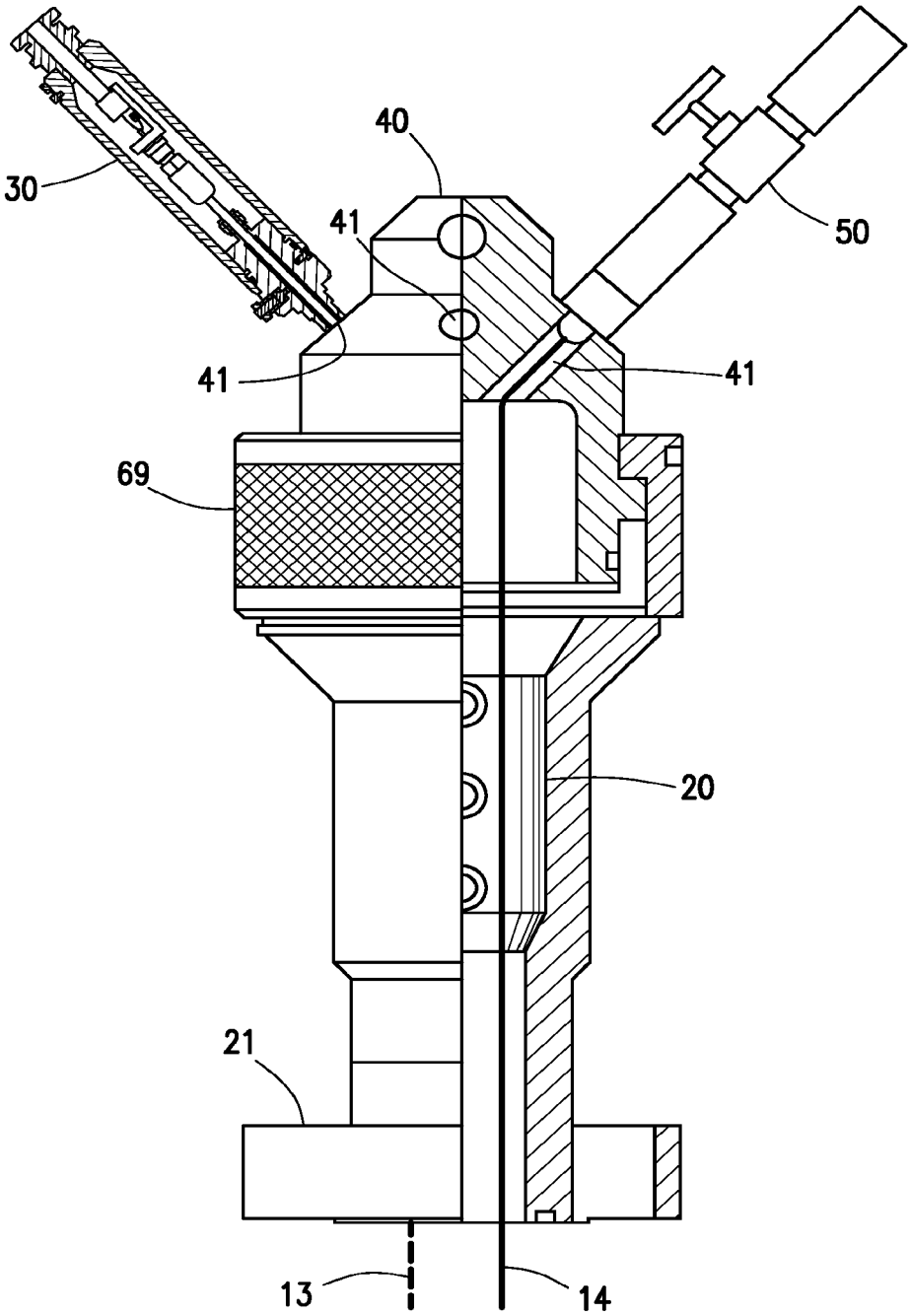
FIG. 20 depicts a top portion of suspended fluid sampling and monitoring system consistent with at least one embodiment of the present disclosure.

In some embodiments, as shown in FIG. 18, BOP clamp housing 21 may be positioned below BOP 11. In such embodiments, BOP clamp housing 21 is connected directly to wellhead 12, by, for example, a flange-type connection. BOP clamp housing 21 may include clamp housing connection 68, which in some embodiments may include a quick union connection. BOP connection 67 may be adapted to mate with clamp housing connection 68 to form complete connection 69, as shown in FIG. 20, as described further hereinbelow. In certain embodiments, BOP 11 may be removed after installation of suspended fluid sampling and monitoring system 25.

Figure 5C:
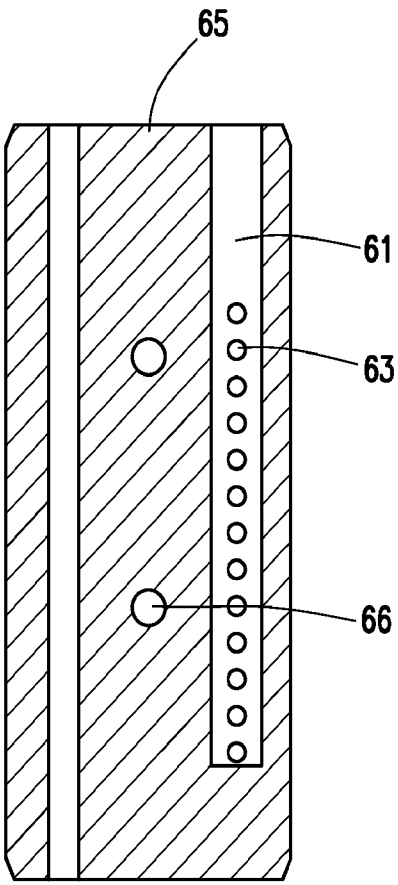
FIG. 5C depicts a cross-section of the downhole fluid sample intake and filtration device of FIG. 5A.
Figure 5B:
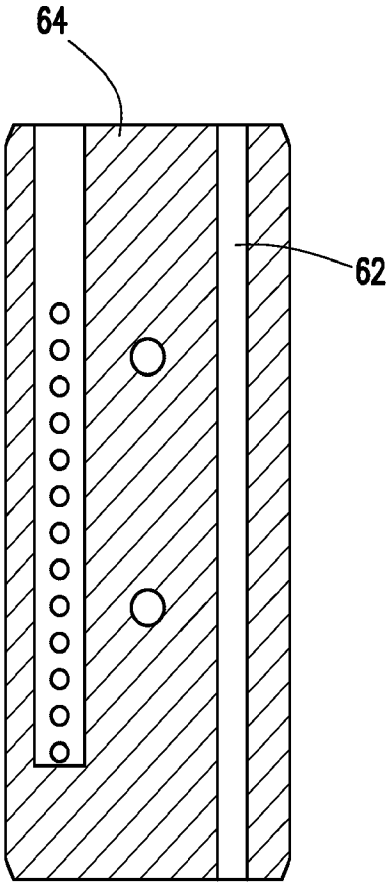
FIG. 5B depicts a cross-section of the downhole fluid sample intake and filtration device of FIG. 5A.
Figure 5A:
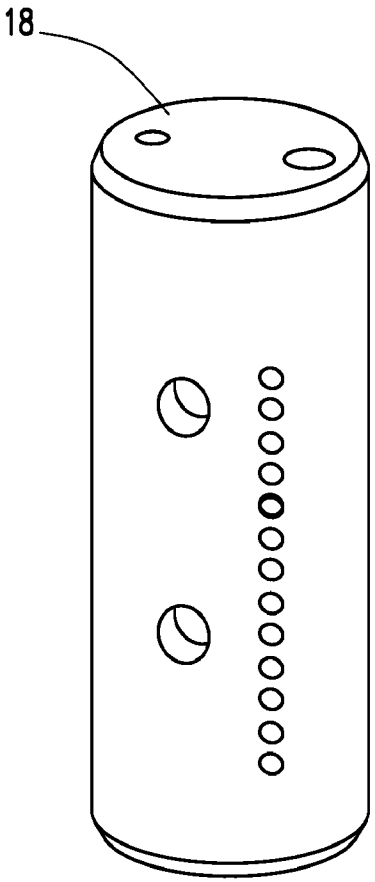
FIG. 5A depicts a downhole fluid sample intake clamp consistent with at least one embodiment of the present disclosure.

FIGS. 5A, 5B & 5C depict a non-limiting embodiment of fluid sample intake and filtration device 18. Fluid sample intake and filtration device 18 includes fluid intake hydraulic conduit 61 through which fluid sample line 14 is terminated. Fluid sample intake and filtration device 18 further includes electrical conduit 62 through which TEC 13 is passed. The wall of fluid intake hydraulic conduit 61 has perforations 63. In certain embodiments, perforations 63 may be sized to function as a filtration system to restrict solids entry to fluid sample line 14. Fluid sample intake and filtration device 18 may include fluid intake split bodies 64 and 65. In certain embodiments, fluid intake split bodies 64 and 65 may be clamped around fluid sample line 14 and TEC 13. Screws, such as cap screws (not shown) may be inserted through fluid intake split body 64 and screwed into threaded holes 66 in fluid intake split body 65 to retain fluid intake split bodies 64 and 65 in position.

Figure 6C:
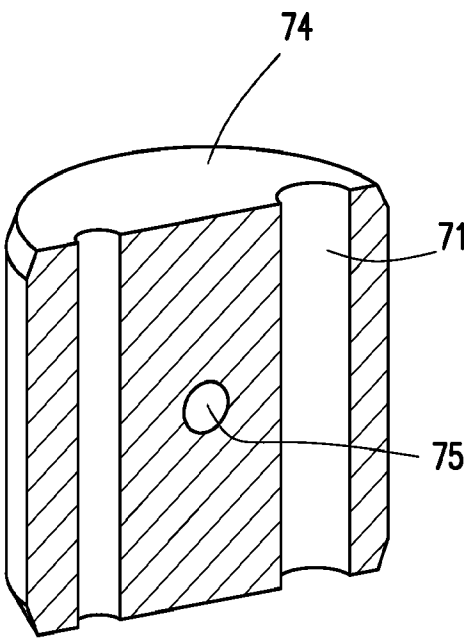
FIG. 6C is a cross-section of the downhole multi-line clamp of FIG. 6A.
Figure 6B:
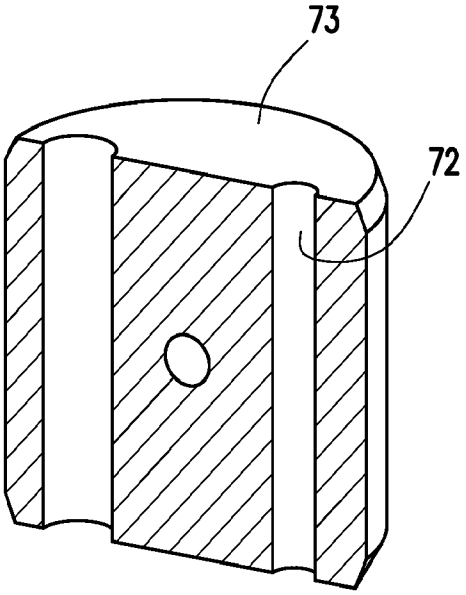
FIG. 6B is a cross-section of the downhole multi-line clamp of FIG. 6A.
Figure 6A:
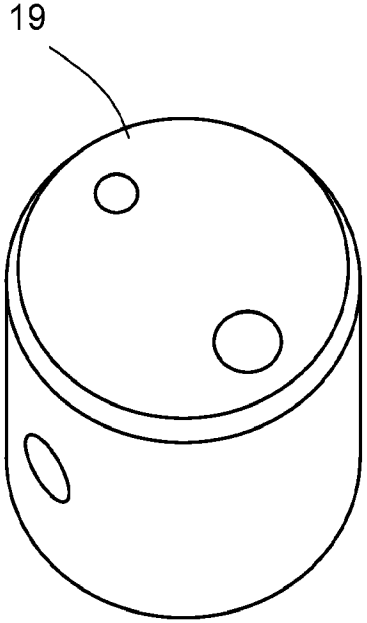
FIG. 6A depicts a downhole multi-line clamp consistent with at least one embodiment of the present disclosure.

FIGS. 6A, 6B & 6C depict a non-limiting embodiment of multi-line clamp 19. Multi-line clamp 19 includes clamp hydraulic conduit 71 through which fluid sample line 14 passes, and clamp electrical conduit 72 through which TEC 13 passes. Multi-line clamp 19 may include clamp split bodies 73 and 74. In certain embodiments, clamp split bodies 73 and 74 may be clamped around fluid sample line 14 and TEC 13. Screws, such as cap screws (not shown) may be inserted through clamp split body 73 and screwed into threaded holes 75 in clamp split body 74 to retain clamp split bodies 73 and 74 in position.

Figure 7A:
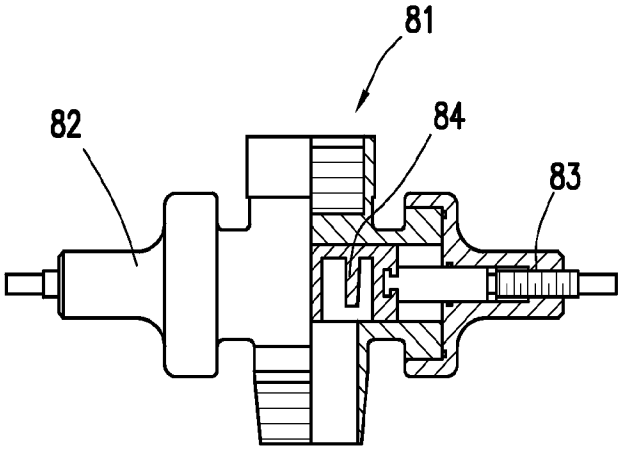
FIG. 7A depicts a cross-sectional view of a multi-line blow out preventer consistent with at least one embodiment of the present disclosure.

FIG. 7A depicts a non-limiting embodiment of BOP 11. BOP 11 may include BOP body 81, BOP caps 82, BOP screws 83 and BOP rams 84. BOP caps 82 are affixed to BOP body 81, such as by threading BOP caps 82 onto BOP body 81. BOP screws 83 may be threaded into BOP caps 82; BOP screws 83 may be adapted to compress BOP ram 84.

As shown in FIGS. 7B1-7B3, BOP rams 84 may include ram plate 85 and ram rubber 86. Ram plate 85 includes ram plate protrusion 85*a*. Ram rubber 86 may include ram rubber receiver 85*b*. Ram rubber receiver 85*b* may be adapted to receive ram plate protrusion 85*a*. Ram rubber 86 may be moulded with center conduit 86*a* to encompass fluid sample line 14 and TEC 13. During deployment of the BHA toolstring 17 on TEC 13 into borehole 1, BOP rams 84 are fully retracted. Once BHA toolstring 17 has reached a target depth in borehole 1, or in the event of a pressure anomaly in borehole 1, such as a pressure anomaly originating from the geological formation 15, BOP screws 83 may be actuated manually (using screw handles not shown) or hydraulically. The consequential rotation of BOP screws 83 causes inward motion of BOP ram plates 85, compressing BOP ram rubbers 86 around the fluid sample line 14 and TEC 13 to create a seal.

Figure 8:
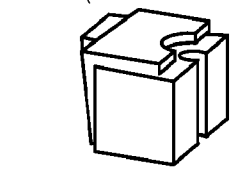
FIG. 8 depicts a tubing encapsulated cable consistent with at least one embodiment of the present disclosure.
Figure 8:
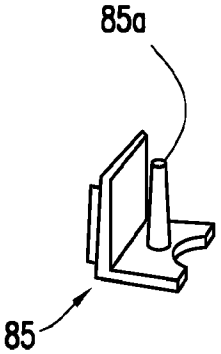
Figure 8:
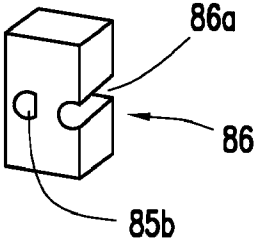
Figure 8:
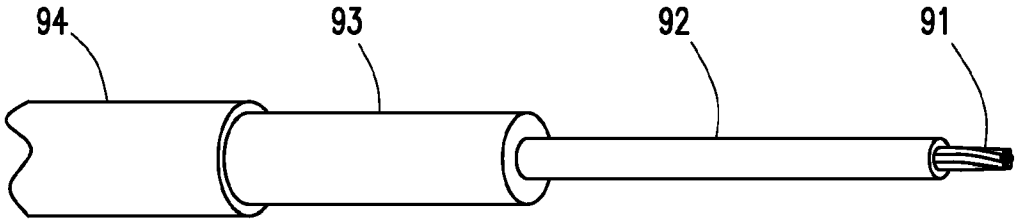

FIG. 8 depicts a non-limiting embodiment of TEC 13. As shown in FIG. 8, TEC 13 may include core conductor 91, core insulator 92, filler 93 and outer metal tube 94. Core conductor 91 may include one or more wires adapted to transmit data and/or power. Core conductor wires may be constructed of a conductor, such as copper. Core insulator 92 circumferentially surrounds core conductor 91 and may be formed of an electrically-insulating material. Core insulator 92 may be circumferentially surrounded by outer metal tube 94. Outer metal tube 94 may provide mechanical strength to support the combined weight of the BHA toolstring 17 and weight of the TEC 13 in borehole 1, withstand borehole pressure and provide a polished surface for a compression fitting. Outer metal tube 94 may be composed of steel, for instance, stainless steel. In certain embodiments, filler 93 may be positioned between outer metal tube 94 and core insulator 92. Filler 93 may be constructed of a polymer, including, but not limited to polypropylene. Other configurations, incorporating multiple separate insulated conductors, each using solid or stranded wire, of varying size, and without a filler material, are contemplated by this disclosure.

Figure 9:
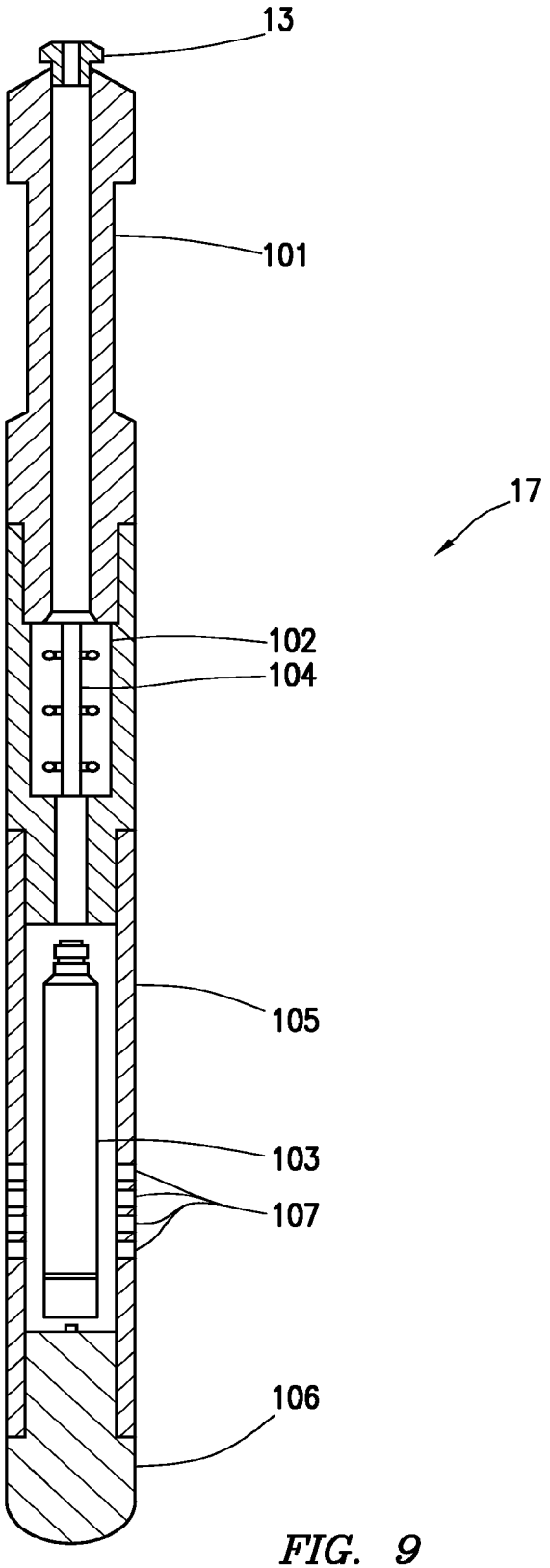
FIG. 9 depicts a cross-section of a bottom hole assembly toolstring consistent with at least one embodiment of the present disclosure.

FIG. 9 depicts a non-limiting embodiment of BHA tool string 17. BHA toolstring 17 may include sliding fishing neck 101, clamp housing 102, downhole sensor package 103, downhole wire clamp 104, sensor housing 105, and bullnose 106. In certain embodiments, sensor housing 105 may include one or more fluid entry ports 107 adapted to allow fluid 24 to pass therethrough. BHA toolstring 17 may be assembled as described hereinbelow.

Figure 10A:
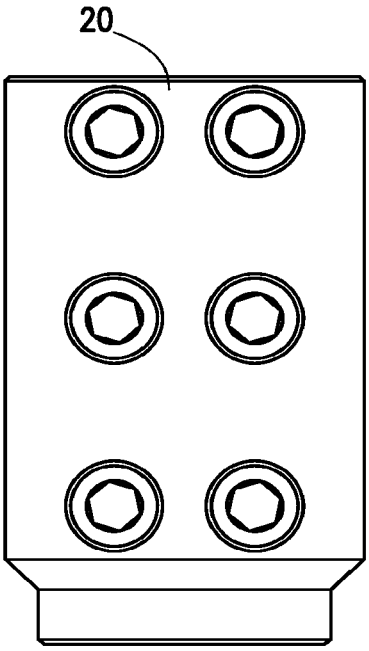
FIGS. 10A-10C depict a BOP multi-line clamp consistent with at least one embodiment of the present disclosure.
Figure 10B:
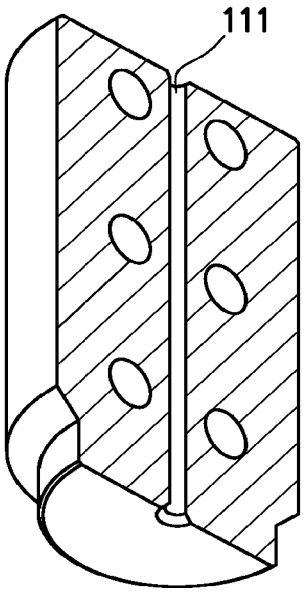
Figure 10C:
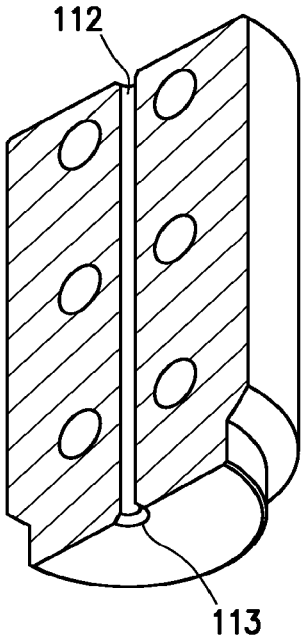

FIGS. 10A-10C depict a non-limiting embodiment of BOP multi-line clamp 20. BOP multi-line clamp 20 may include BOP multi-line clamp split bodies 111 and 112, with a single TEC/fluid sample line conduit 113 therein. Cap screws may be inserted through split body 111 and screwed into threaded holes in split body 112 to a predetermined torque. In yet another embodiment (not shown) the BOP multi-line split bodies 111 and 112 incorporate separate conduits for the TEC 13 and fluid sample line 14.

In certain embodiments of the present disclosure, installation of suspended fluid sampling and monitoring system 25 may include bleeding off pressure from wellhead 12 through a wing valve (not shown) on the wellhead 12. BOP 11, and in some embodiments wellhead adapter spool 40, is assembled onto wellhead 12. TEC spooling unit 8 and tube spooling unit 9 for TEC reel 5 and hydraulic tube reel 7, respectively, are positioned at surface 2 near borehole 1. TEC 13 and fluid sampling line 14 from TEC reel 5 and hydraulic tube reel 7, respectively, may be fed through sheave 10 suspended above BOP 11.

BHA toolstring 17 may be assembled by sliding fishing neck 101 and clamp housing 102 over TEC 13 before connecting downhole sensor package 103 onto TEC 13. Downhole wire clamp 104 may be mechanically coupled to TEC 13. Clamp housing 102 may be slid over downhole wire clamp 104 and screwed into sliding fishing neck 101. Sensor housing 105 may be slipped over downhole sensor package 103 and screwed into clamp housing 102, before making up bullnose 106 to sensor housing 105.

Fluid sample intake and filtration device split bodies 64 and 65 may be placed around TEC 13 above BHA toolstring 17, with cap screws inserted through split body 64 and screwed into the threaded holes 66 in split body 65. Fluid sampling line 14 may be terminated into fluid intake hydraulic conduit 61 and secured. As BHA toolstring 17 is lowered into borehole 1, multi-line clamps 19 may be installed at intervals, for example, approximately every 30 ft, around both TEC 13 and fluid sampling line 14. Multi-line clamps 19 may act to dissipate some of the weight of the BHA toolstring 17 and TEC 13 into fluid sample line 14.

Once the BHA toolstring 17 has been lowered to a target depth, TEC 13 and fluid sampling line 14 may be inserted into BOP multi-line clamp 20. BOP multi-line clamp 20 may be lowered to rest on a bowl profile machined into the internal face of BOP clamp housing 21 affixed to BOP 11. BOP ram rubbers 86 may be compressed onto TEC 13 and fluid sample line 14, and surface telemetry unit 3 may be connected to TEC reel 5 using surface electrical cable 4.

In another embodiment, installation of suspended fluid sampling and monitoring system 25 may include bleeding off pressure from wellhead 12 through a wing valve (not shown) on the wellhead 12. BOP 11, and in some embodiments wellhead adapter spool 40, is assembled onto wellhead 12. TEC spooling unit 8 and tube spooling unit 9 for TEC reel 5 and hydraulic tube reel 7, respectively, are positioned at surface 2 near borehole 1. TEC 13 and fluid sampling line 14 from TEC reel 5 and hydraulic tube reel 7, respectively, may be fed through sheave 10 suspended above BOP 11.

BHA toolstring 17 may be assembled by sliding fishing neck 101 and clamp housing 102 over TEC 13 before connecting downhole sensor package 103 onto TEC 13. Downhole wire clamp 104 may be mechanically coupled to TEC 13. Clamp housing 102 may be slid over downhole wire clamp 104 and screwed into sliding fishing neck 101. Sensor housing 105 may be slipped over downhole sensor package 103 and screwed into clamp housing 102, before making up bullnose 106 to sensor housing 105.

Fluid sample intake and filtration device split bodies 64 and 65 may be placed around TEC 13 above BHA toolstring 17, with cap screws inserted through split body 64 and screwed into the threaded holes 66 in split body 65. Fluid sampling line 14 may be terminated into fluid intake hydraulic conduit 61 and secured. As BHA toolstring 17 is lowered into borehole 1, multi-line clamps 19 may be installed at intervals, for example, approximately every 30 ft, around both TEC 13 and fluid sampling line 14. Multi-line clamps 19 may act to dissipate some of the weight of the BHA toolstring 17 and TEC 13 into fluid sample line 14.

Once BHA toolstring 17 has been lowered to a target depth, TEC 13 and fluid sampling line 14 may be inserted into BOP multi-line clamp 20. BOP multi-line clamp 20 may be lowered to rest on a bowl profile machined into the internal face of BOP clamp housing 21 affixed to BOP 11. BOP ram rubbers 86 may be compressed onto TEC 13 and fluid sample line 14.

TEC 13 and fluid sample line 14 may be cut at TEC reel 5 and hydraulic tube reel 7, respectively, and routed through the bore of wellhead adapter spool 40, which is assembled on to the top of BOP clamp housing 21. TEC 13 connected to BHA toolstring 17 may be routed through ported bullplug 22 that is assembled onto the top of wellhead adapter spool 40, with TEC 13 terminated inside EWO 30 that is screwed into the threaded port in bullplug 22. Fluid sample line 14 extended through borehole 1 may be terminated into HWO 50 that is screwed into one of the four ports 41 in wellhead adapter spool 40. Surface telemetry unit 3 may be connected to EWO 30 using surface electrical cable 4.

Figure 19:
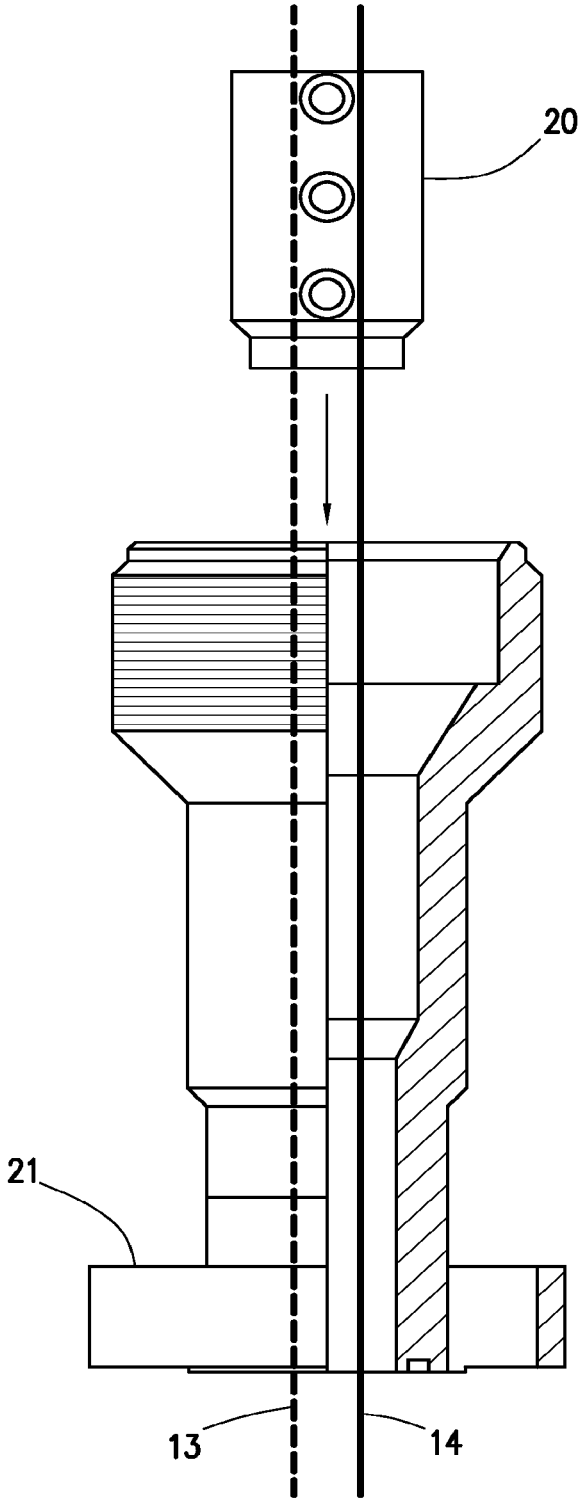
FIG. 19 depicts a top portion of suspended fluid sampling and monitoring system consistent with at least one embodiment of the present disclosure.

In certain embodiments, such as the embodiments depicted in FIGS. 18-20, BOP 11 may be removed after installation of suspended fluid sampling and monitoring system 25. During installation of suspended fluid sampling and monitoring system 25, BOP clamp housing 21 is attached to wellhead 12; BOP 11 may then be attached to BOP clamp housing 21, wherein BOP connection 67 mates with clamp housing connection 68. BHA toolstring 17, TEC 13 and/or fluid sample line 14 may be run through the BOP 11, along with, in certain embodiments, multi-line clamps 19. When BHA toolstring 17 has reached a predetermined depth, BOP connection 67 may be disconnected from clamp housing connection 68 so that BOP 11 is removed, such as through lifting using a suitable lifting device, for example, a crane. BOP multi-line clamp 20 may be affixed around TEC 13 and/or fluid sample line 14, as shown in FIG. 19. TEC 13 and/or fluid sample line 14 may be lowered to seat BOP multi-line clamp 20 onto seat 70 in BOP clamp housing 21, as shown in FIG. 18. TEC 13 and/or fluid sample line 14 may be cut above the BOP multi-line clamp 20, thereby allowing BOP 11 to be removed. The ends of TEC 13 and/or fluid sample line 14 may be fed through ports 41 in wellhead adapter spool 40, which may include a connection to allow connection to BOP clamp housing 21, forming complete connection 69. TEC 13 may be terminated into EWO 30 and fluid sample line 14 may be terminated into HWO 50, as shown in FIG. 20.

In certain embodiments, a water sampling method may be used to extract volume $V_s$ of fluid 24 from an aquifer not initially present, i.e., new water from the aquifer, in borehole 1 from geological formation 15 and displace volume $V_s$ of fluid 24 to surface 2. In certain embodiments, the water sampling method includes:

1. Calibration blowdown step—determine the volume of fluid injected into geological formation 15 per unit volume of borehole fluid displaced through fluid sample line 14;

2. Initial blowdown step—displace additional fluid initially present in borehole 1;

3. Fluid level build-up step—allow fluid from the aquifer to enter borehole 1; during the fluid level build-up period, the fluid level is allowed to rise to its original level through discharge of fluid from geological formation 15 under available pore pressure;

4. Main blowdown step—recover sample of fluid 24 from borehole 1, i.e., fluid newly entering borehole 1 from the aquifer.

Figure 11:
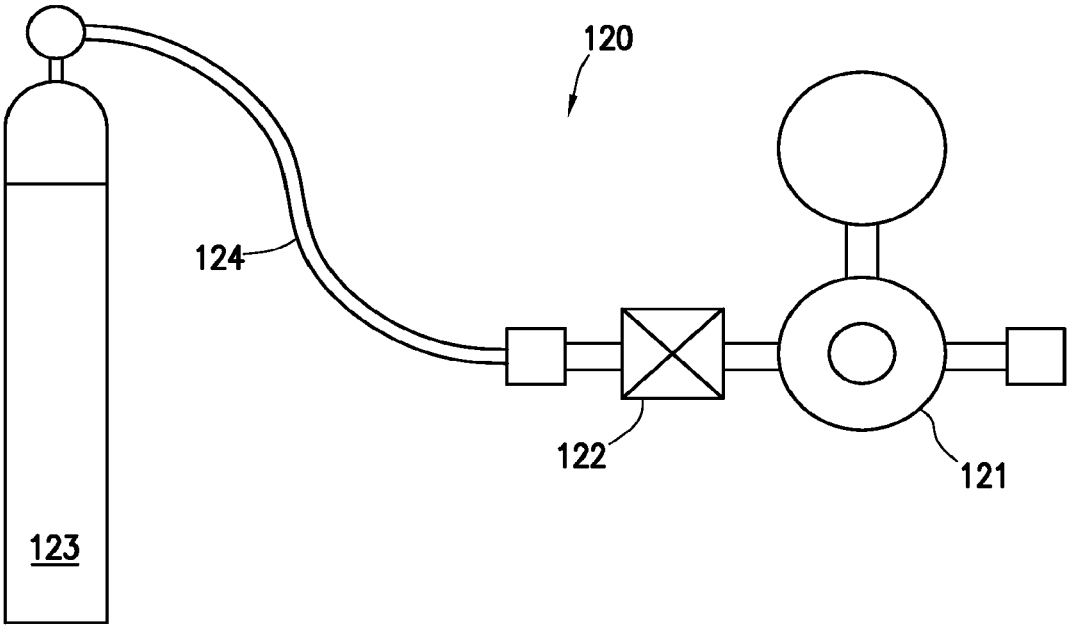
FIG. 11 depicts a blowdown pressure manifold consistent with at least one embodiment of the present disclosure.

In the water sampling method, downhole pressure may be determined, for instance, by surface telemetry unit 3. In certain embodiments, the water sampling method may use blowdown control manifold (BCM) 120. BCM 120, as shown in FIG. 11, is connected to port 41 (designated a blowdown port) on wellhead adapter spool 40. FIG. 11 depicts one embodiment of BCM 120 wherein BCM 120 is connected to gas source 123. Gas source 123 may contain, for instance, nitrogen or air. In some embodiments, a gas cylinder, an air compressor, nitrogen tank, or nitrogen generation unit may be connected to BCM 120 as gas source 123. BCM 120 may include control valve 121 attached to isolation valve 122. Isolation valve 122 may be connected to gas source 123 via BCM hose 124.

Figure 12:
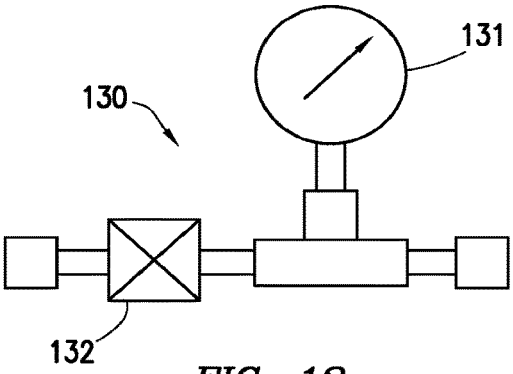
FIG. 12 depicts a bleed off manifold consistent with at least one embodiment of the present disclosure.

In an embodiment of the water sampling method, EWO 30 and HWO 50 are connected to other ports 41 in wellhead adapter spool 40. Bullplug 22 may be fitted to the top of BOP clamp housing 21. In certain embodiments, a pressure gauge may be connected to another port 41 in wellhead adapter spool 40 to monitor wellhead pressure. The pressure gauge may be part of bleed off manifold (BOM) 130 as shown in FIG. 12. In the embodiment depicted in FIG. 12, BOM 130 is connected to the port 41 on wellhead adapter spool 40 (designated a bleed off port), and includes pressure gauge 131 to monitor gas cap pressure. BOM 130 may include BOM valve 132, which in some embodiments, may be a needle valve.

Calibration Blowdown Step:

When pressure is applied to borehole 1, only a portion of the displaced volume of fluid 24 will emerge from borehole 1 at surface 2, such as through HWO 50. The remainder of displaced volume of fluid 24 volume will be injected into geological formation 15. In the initial calibration blowdown step, the gas cap pressure needed to displace a volume $V_b$ of borehole fluid is determined.

Without being bound by theory, injecting a gas at pressure P into head space will depress a fluid column height h at speed v equating to volumetric rate Q. Some fluid will be discharged up the sampling tube at rate $Q_2$ with remainder injected into the reservoir at rate $Q_3$. Bernoulli's Solution indicates that to achieve a given $Q_2$:

$Q_3$ will increase with injectivity Index $Q_3$ will increase with increasing head space height $Q_3$ increases with increasing tube friction loss (which increases with well depth and decrease in sample tube diameter Again, without being bound by theory, Bernoulli's Solution may be stated as:

$$Q_3 = I\left(\frac{8\rho}{\pi^2 D_t^4} Q_2^2 + P_a + \Delta P_f + \rho g h_{hs}\right)$$

Figure 17D:
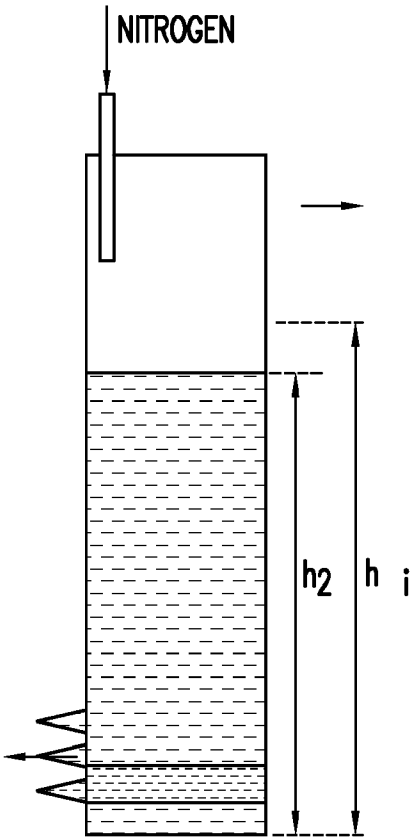
FIGS. 17A-17D depict a water sampling method consistent with at least one embodiment of the present disclosure.
Figure 17C:
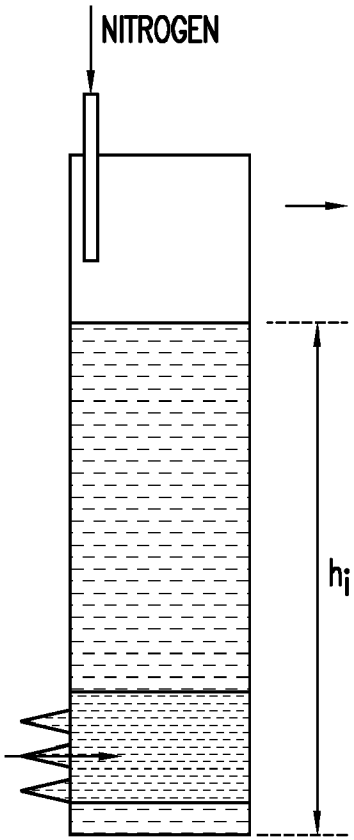

In certain embodiments of the present disclosure, control valve 121 in BCM 120 may be set to a calibration gas cap pressure and sample release valve 53 in HWO 50 may be opened. Isolation valve 122 in BPM 120 may be opened, allowing gas from gas source 123 to enter borehole 1, depressing the fluid column down borehole 1 from $h_i$ (initial fluid 24 height) to $h_c$ (fluid 24 height after calibration) as shown in FIG. 17A. The total volume of fluid $V_t$ emerging through HWO 50 is determined using, for instance, a graduated cylinder, with the change in borehole pressure used to verify the total volume $V_b$ displaced down borehole 1. $V_r$ is then determined as follows:

$$V_r=(V_b-V_t)/V_t \qquad \text{Equation 1}$$

The volume $V_{d1}$ to be displaced in the subsequent first initial blowdown step is then given by the following equation:

$$V_{d1}=V_s(V_r+1)^2 \qquad \text{Equation 2}$$

The volume $V_{d2}$ to be displaced in the main blowdown step following the fluid level build-up period is then given by the following equation:

$$V_{d2}=V_s(V_r+1)+V_{cl} \qquad \text{Equation 3}$$

where $V_{cl}$ is the volume of the fluid sample line.

In certain embodiments, a blowdown volume calculator may be used to determine a gas cap pressure needed to displace a specific volume of fluid from borehole 1 as a function of the current measured downhole pressure displayed in surface telemetry unit 3 and other input data shown in Table 1.

TABLE 1

| User Data Entry | | |
|---|---|---|
| Downhole Pressure | 1084.25 | psia |
| Surface Pressure | 1.81 | psia |
| Atmospheric Pressure | 14.70 | psi |
| Gauge Depth | 805.23 | mGL |
| Sample Intake | 801.26 | mGL |
| Sample Tube Size | 0.250 | in OD |
| Sample Tube Wall Thickness | 0.028 | in |
| Casing Size & Weight | 4.50" 16.90# | in & lb/ft |
| Water Density | 8.32 | ppg |
| Water Sample Size | 5.00 | L |
| Injectivity Index Loss Ratio | 2.00 | :1 |
| Formation Fracture Point | 1280.00 | psia |
| Nitrogen Bottle Volume | 47.5 | L |
| $N_2$ Bottle Pressure (New) | 4300 | psig |
| $N_2$ Bottles Available | 1 | Unit(s) |
| Remaining $N_2$ Bottle Pressure | 4300 | psig |

Values for displacement volumes $V_{d1}$ and $V_{d2}$, the associated changes in fluid height $h_i$ and $h_1$ and gas cap pressures $P_1$ (first gas cap pressure) and $P_2$ (second gas cap pressure) needed to induce these changes may be computed by a blowdown volume calculator once $V_b$ and $V_t$ are measured. $P_1$ and $P_2$ may be different or the same. The blowdown volume calculator may also compute the volumes $V_{w1}$ and $V_{w2}$ recovered at HWO 50 during the initial and main blowdown steps respectively. An example of the computed data output by the blowdown volume calculator is shown in Tables 2A and 2B.

TABLE 2A

| Calculations 1st Blow Down | | |
|---|---|---|
| Fluid Level | 53.03 | mGL |
| Casing ID | 3.74 | in |

TABLE 2A-continued

| Calculations $1^{st}$ Blow Down | | |
|---|---|---|
| Sample Tube ID | 0.194 | in |
| Sample Tube Volume | 61.12 | L |
| Sample Tube Displacement in Casing | 13.99 | m |
| $1^{st}$ Displacement Fluid | 3.43 | m |
| Required $N_2$ Pressure | 4.87 | psig |
| $1^{st}$ Blow Down Volume Recovered | 45.00 | L |
| Casing Volume Fluid Level | 1.5035 | $m^3$ |
| Fracture Point > Hydrostatic & Blow Down | YES | |
| Nitrogen Bottle Volume | 0.0475 | $m^3$ |
| No. of $N_2$ Bottles Required | 0.04 | Unit(s) |
| Sufficient Bottles Available | YES | |
| $N_2$ Potential Blow Down | 131.69 | psig |
| Sufficient Blow Down Available | YES | |
| Sample Fluid Recovery Possible | YES | |

TABLE 2B

| Calculations $2^{nd}$ Blow Down | | |
|---|---|---|
| Fluid Level | 53.03 | mGL |
| Casing ID | 3.74 | in |
| Sample Tube ID | 0.19 | in |
| Sample Tube Volume | 61.12 | L |
| Sample Tube Displacement in Casing | 13.99 | m |
| $2^{nd}$ Displacement Fluid | 1.14 | m |
| Required $N_2$ Pressure | 96.76 | psig |
| $2^{nd}$ Blow Down Volume Recovered | 76.12 | L |
| Casing Volume Fluid Level | 1.5035 | $m^3$ |
| Fracture Point > Hydrostatic & Blow Down | YES | |
| Nitrogen Bottle Volume | 0.0475 | $m^3$ |
| No. of $N_2$ Bottles Required | 0.73 | Unit(s) |
| Sufficient Bottles Available | YES | |
| $N_2$ Potential Blow Down | 131.69 | psig |
| Sufficient Blow Down Available | YES | |
| Sample Fluid Recovery Possible | YES | |

After completion of the calibration blowdown step, in certain embodiments, the pressure of borehole 1 may be allowed to return to the initial borehole pressure and the height of fluid 24 allowed to return to the initial height $h_i$. In other embodiments, after the calibration blowdown step, borehole pressure and height of fluid 24 do not return to the initial borehole pressure and initial height $h_i$.

Figure 17B:
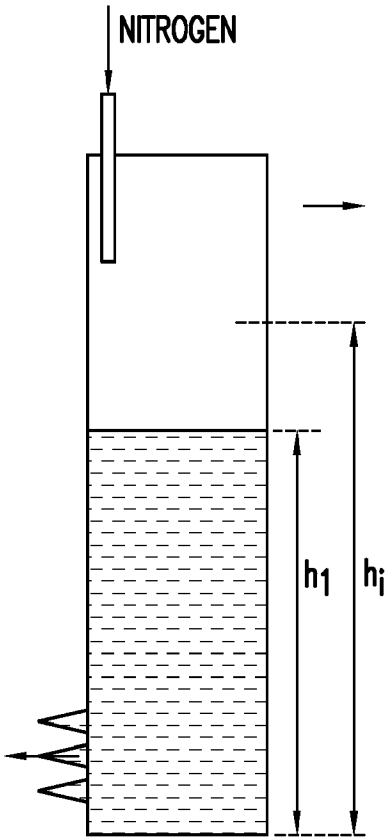
Figure 17A:
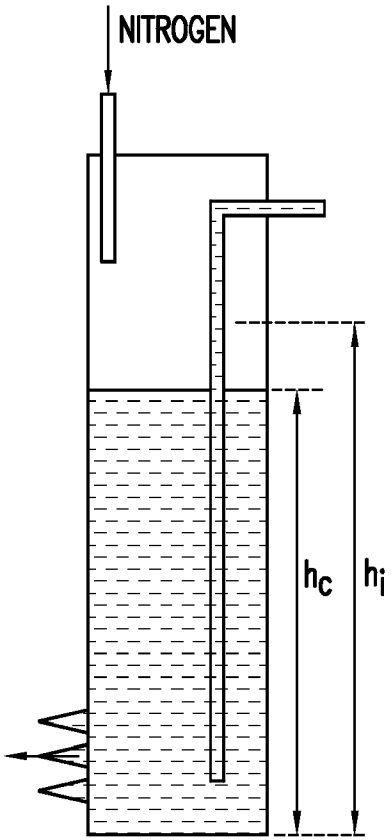

Initial Blowdown Step:

As shown in FIG. 17B, once a value for $P_1$ has been determined in the calibration blowdown step, control valve 121 in the BCM 120 may be set to $P_1$ and sample release valve 53 in HWO 50 opened. Isolation valve 122 in the BPM 120 is opened to execute the initial blowdown step, allowing compressed gas from gas source 123 to enter borehole 1, depressing the fluid column down borehole 1 to $h_1$ as shown in FIG. 17B, with volume $V_{w1}$ recovered at HWO 50 via fluid sample intake and filtration device 18 and fluid sample line 14.

Fluid Level Buildup Step:

As shown in FIG. 17C, sample release valve 53 in HWO 50 may be closed and isolation valve 122 may be closed on BCM 120. BOM valve 132 on BOM 130 may be opened to bleed off the gas cap pressure in borehole 1 and allow the borehole pressure to return to the initial borehole pressure, i.e, the pressure recorded at the start of the calibration blowdown step. Bottom hole pressure readings may be monitored during the fluid level build-up step.

Main Blowdown Step:

As shown in FIG. 17D, after the bottom hole pressure reaches the same value recorded at the start of the calibration blowdown step, BOM valve 132 on BOM 130 is closed, control valve 121 in the BCM 120 is set to $P_2$ and fluid sample release valve 53 in the HWO 50 is again opened. Isolation valve 122 in the BCM 120 is opened also to execute the main blowdown period, allowing compressed gas from the gas source 123 to enter the wellbore, depressing the fluid column down borehole 1 to $h_2$ with volume $V_{w2}$ recovered at the HWO 50 via fluid sample intake and filtration device 18 and fluid sample line 14. Water originating from the geological formation 15 will reach the HWO 50 after a volume ($V_{w2}-V_s$) has been recovered. In some embodiments, arrival of water originating from geological formation 15 may be verified by monitoring for transition in water properties such as salinity, pH, fluorescence potential, turbidity, etc. The remaining recovered volume $V_s$ of new water may be transferred to suitable containers for laboratory analysis.

Once the desired volume $V_s$ of water has been collected at surface 2, sample release valve 53 in the HWO 50 is then closed and the isolation valve 122 closed at the BCM 120. BOM valve 132 on BOM 130 is opened to bleed off the gas cap pressure in borehole 1. BCM 120 and BOM 130 may be detached from wellhead adapter spool 40, with plugs screwed into the exposed ports 41.

In some embodiments, sample release valve 53 in HWO 50 is adjusted to maintain a backpressure on the fluid emerging from fluid sample line 14 during the main blowdown step to capture pressurized samples. In those embodiments, the pressurized samples may include solubilized gasses.

Depending on the context, all references herein to the "disclosure" may in some cases refer to certain specific embodiments only. In other cases it may refer to subject matter recited in one or more, but not necessarily all, of the claims. While the foregoing is directed to embodiments, versions and examples of the present disclosure, which are included to enable a person of ordinary skill in the art to make and use the disclosures when the information in this patent is combined with available information and technology, the disclosures are not limited to only these particular embodiments, versions and examples. Other and further embodiments, versions and examples of the disclosure may be devised without departing from the basic scope thereof and the scope thereof is determined by the claims that follow.

What is claimed is:

1. A suspended fluid sampling and monitoring system comprising:

a tubing encapsulated cable ("TEC"), the TEC connected to a sensor package, the TEC and the sensor package extending into a wellbore;

a fluid sample line, the fluid sample line extending into the wellbore; and a fluid sample intake and filtration device, the fluid sample intake and filtration device mechanically coupled to the fluid sample line within the wellbore, wherein the fluid sample intake and filtration device comprises:

a fluid intake hydraulic conduit, the fluid intake hydraulic conduit adapted to terminate the fluid sample line;

a hydraulic conduit wall, the hydraulic conduit wall having perforations; and an electrical conduit, the electrical conduit adapted to pass through the TEC.

2. The suspended fluid sampling and monitoring system of claim 1 further comprising a hydraulic wellhead outlet ("HWO"), the HWO mechanically connected to the fluid sample line.

3. The suspended fluid sampling and monitoring system of claim 1, wherein the TEC, the fluid sample line, and the sensor package are suspended from a blowout preventer ("BOP"), the BOP attached to a wellhead, the BOP positioned above the wellbore, wherein the TEC extends through the BOP, and wherein the fluid sample line extends through the BOP.

4. The suspended fluid sampling and monitoring system of claim 1, wherein the TEC, the fluid sample line, and the sensor package are suspended from a seat in a BOP clamp housing, the BOP clamp housing positioned above the wellbore, wherein the TEC extends through the BOP clamp housing, and wherein the fluid sample line extends through the BOP clamp housing.

5. The suspended fluid sampling and monitoring system of claim 1, wherein the sensor package is mounted in a bottom hole assembly ("BHA") tool string.

6. The suspended fluid sampling and monitoring system of claim 1, wherein the sensor package is adapted to measure temperature, pressure, fluid conductivity, pH or a combination thereof.

7. The suspended fluid sampling and monitoring system of claim 1, further comprising a junction box, the junction box mechanically connecting the TEC to a surface electrical cable.

8. The suspended fluid sampling and monitoring system of claim 7, wherein electrical power is transmitted to the sensor package by a surface telemetry unit via the surface electrical cable and the TEC.

9. The suspended fluid sampling and monitoring system of claim 8, wherein the surface telemetry unit is adapted to process data, store data, transmit data, or a combination thereof.

10. The suspended fluid sampling and monitoring system of claim 1, wherein a portion of the TEC is spooled on an electrical cable reel.

11. The suspended sampling and monitoring system of claim 1, wherein the fluid sample line extends from a hydraulic tube reel.

12. The suspended sampling and monitoring system of claim 1, wherein the fluid sample intake and filtration device is located proximate an aquifer within a formation.

13. The suspended sampling and monitoring system of claim 1, wherein the fluid sample line is clamped to the TEC at intervals within the wellbore.

14. A suspended fluid sampling and monitoring system comprising:

a blowout preventer ("BOP"), the BOP attached to a wellhead, the BOP positioned above a wellbore;

a tubing encapsulated cable ("TEC"), the TEC connected to a sensor package, the TEC extending through the BOP into the wellbore, the TEC having a free end located outside the wellbore;

a fluid sample line, the fluid sample line extending through the BOP into the wellbore, the fluid sample line having a free end located outside the wellbore, the fluid sample line terminating in a fluid sample intake and filtration device;

a hydraulic wellhead outlet ("HWO"), the HWO mechanically connected to the fluid sample line, wherein the HWO comprises:

a pressure-blocked feedthrough assembly;

a feedthrough connector, the feedthrough connector mechanically coupled to the pressure-block feedthrough assembly;

a sample release valve, the sample release valve mechanically coupled to the feedthrough connector; and a quick connect fitting, the quick connect fitting mechanically coupled to an isolation valve; and an electrical wellhead outlet ("EWO"), the EWO mechanically connecting the TEC to a surface electrical cable.

15. The suspended fluid sampling and monitoring system of claim 14, wherein the free end of the TEC is connected through a first port of a wellhead adapter spool to the EWO.

16. The suspended fluid sampling and monitoring system of claim 15, wherein the free end of the fluid sample line is connected through a second port of a wellhead adapter spool to the HWO.

17. The suspended fluid sampling and monitoring system of claim 14, wherein the fluid sample intake and filtration device is comprised of a first split body and a second split body, wherein the first split body and the second split body are adapted to clamp around the fluid sample line and the TEC.

18. The suspended fluid sampling and monitoring system of claim 14, further comprising a multi-line clamp, the multi-line clamp comprising a clamp hydraulic conduit adapted to allow the fluid sample line to pass through the multi-line clamp and a clamp electrical conduit, the clamp electrical conduit adapted to allow the TEC to pass through the multi-line clamp.

19. The suspended fluid sampling and monitoring system of claim 14, wherein the fluid sample intake and filtration device comprises:

a fluid intake hydraulic conduit, the fluid intake hydraulic conduit adapted to terminate the fluid sample line;

a hydraulic conduit wall, the hydraulic conduit wall having perforations; and an electrical conduit, the electrical conduit adapted to pass through the TEC.

* * * * *